United States Patent [19]

Hisey

[11] Patent Number: 4,535,686

[45] Date of Patent: Aug. 20, 1985

[54] CHIMNEY CAP

[75] Inventor: Durward A. Hisey, St. Louis County, Mo.

[73] Assignee: Hy-C Company, Inc., St. Louis, Mo.

[21] Appl. No.: 588,746

[22] Filed: Mar. 12, 1984

Related U.S. Application Data

[60] Continuation-in-part of Ser. No. 545,229, Oct. 25, 1983, , which is a division of Ser. No. 357,733, Mar. 12, 1982, Pat. No. 4,436,021.

[51] Int. Cl.[3] ..... F23L 17/02

[52] U.S. Cl. ..... 98/67

[58] Field of Search ..... 24/543, 563; 98/59, 98/67, 83, 122; 248/150, 151, 165, 188, 529

[56] References Cited

U.S. PATENT DOCUMENTS

| | | | |
|---|---|---|---|
| 44,182 | 9/1864 | Griffith | 98/67 |
| 197,150 | 11/1877 | Lichtenfels | 98/67 |
| 281,645 | 7/1883 | Rosenstar | 98/67 |
| 312,918 | 2/1885 | Steen | 98/67 |
| 377,508 | 2/1888 | Wright | 98/67 |
| 477,918 | 6/1892 | Taylor | 248/151 X |
| 841,660 | 1/1907 | Barnes | 98/67 |
| 1,622,431 | 3/1927 | Feigenbaum | 98/67 |
| 2,660,106 | 11/1953 | Gray | 98/83 |
| 2,755,730 | 7/1956 | Douty | 98/67 |
| 2,805,616 | 9/1957 | Roth | 98/67 |
| 2,976,796 | 3/1961 | Anthony et al. | 98/67 |
| 3,227,405 | 1/1966 | Layton | 248/529 X |
| 4,007,759 | 2/1977 | Martin | 98/122 X |
| 4,334,460 | 6/1982 | Simmons et al. | 98/67 |

*Primary Examiner*—Harold Joyce

*Attorney, Agent, or Firm*—Paul M. Derk

[57] ABSTRACT

In a chimney cap for providing coverage for the upper end of a chimney flue, the cap includes a cover, a band arranged there below, sufficient space in between the cover and the band to allow the development of a draft for removal of smoke and fumes, a foraminous screen arranged structurally between the cover and band, and retentioners, in the category of resiliently biasing appendages, removably connecting with the band and for use for tightening of the cap within and to the chimney flue.

6 Claims, 5 Drawing Figures

CHIMNEY CAP

CROSS REFERENCE TO RELATED APPLICATIONS

This application comprises a continuation-in-part of my earlier application having Ser. No. 545,229, filed on Oct. 25, 1983, and which latter application is denomiated as a division of my application having Ser. No. 357,733, filed on Mar. 12, 1982, now U.S. Pat. No. 4,436,021.

BACK OF THE INVENTION

This invention relates generally to an enclosure for the upper end of a chimney, and more specifically pertains to a cap that provides sufficient coverage for preventing the entrance of the elements or wildlife into the chimney flue, and without detracting from the development of the necessary draft required for drawing smoke and fumes from the chimney.

A variety of chimney covers or caps are available in the prior art. Most of these designs are of the type that include a formed exterior strap that is used for tightening of a wire screen securely around the exterior upper edge of the chimney flue, and while these type of caps may serve their purpose for providing some degree of coverage for the upper end of the chimney flue, they do leave something to be desired with respect to the aesthetics of their devices when located in place, in addition to furnishing stable support for connection of their covers to the chimney flue, and to sustain their mounting thereon.

It is, therefore, the principal object of this invention to provide an improved chimney cap that not only enhances the draft of smoke and fumes from the chimney to the leeward, but provides a cap that is pleasing in appearance, and can easily be interconnected and fabricated into a usable condition, and quickly inserted and installed for firmly securing upon the chimney head through the agency of removable retention means that can be rendered functional in a minimum of time.

Another object of this invention is to provide a chimney cap wherein its integral band means that envelops the upper end of the flue incorporates retention means that can be immediately located into place, and tightened with the band means, in ready preparation for its installation upon the chimney flue, wherein the means for retention of the cap thereon will be sufficiently concealed from view after its installation Another object of this invention is to provide a chimney cap wherein the retention means includes appendages that are removable from the cap, as during display for marketing, or during shipment, but that can be readily installed in place for ready application of the same downwardly within the upper edge of the chimney flue, and yet be biased sufficiently in place for more permanent retention through the resiliency inherently designed into its retention means.

Still another object of this invention is to provide means for ensuring precise positioning of the chimney cap upon its flue by incorporating shoulder means within the structure of its retentioners, such as the aforesaid appendages, and which limits the extent of application of the cap onto the chimney flue.

Still another object of this invention is to provide retention means for a chimney cap that biases at least at two points upon the interior of the chimney flue so as to assure that multiple pressure points guarantee that the cap shall remain in place upon the chimney regardless what type of inclement weather may be encountered.

Still another object of this invention is to provide a chimney cap which can be permanently installed in place, upon the chimney flue, while necessitating only the use of a single tool, such as a screw driver, or wrench, during its installation.

Yet another object of this invention is to provide a chimney cap that is thoroughly and structurally stable in its construction, but yet retains enhanced beauty in its aesthetics due to its mechanical applicators and retention means being sufficiently concealed from sight.

These and other objects will become more apparent to those skilled in the art upon reviewing the summary of this invention, and upon undertaking a study of the description of its preferred embodiment, in view of the drawings.

SUMMARY OF THE INVENTION

This invention relates to a chimney cap that is useful for application upon the upper edge of the flue of a chimney head, and one which has been designed containing sufficient inherent structure that allows for its ease of installation by a mechanic, or even easily applied by the homeowner. The chimney cap of this design has desirably been constructed to yet retain all of those features desired from such a cover, and in this particular instance, attaining all of such results without sacrificing the structural integrity of the cover, or necessitating any supplemental metal or other material components that normally would otherwise detract from its appearance. The cover of this invention is designed to help protect the roof of the structure upon which the cap is installed from encountering exiting sparks, as from a fireplace, by incorporating a sufficient expanse of cover so as. to prevent the rain or other elements from attaining entrance downwardly into the chimney, which under other circumstances, may accumlate sufficiently so as to cause leakage into the fireplace, or in proximity of the furnace, and in addition, the structural makeup of this cap includes a foraminous screen or other member that totally precludes the entrance of birds, squirrels, or the like, from also attaining access into the chimney. In addition, even though all of the foregoing advantages for this invention are met from its structure, the cap does not detract from the development of sufficient draft surrounding the vicinity of the chimney head, so as to allow for total exiting of smoke and fumes from the chimney or the other operating instrumentalities with which it is associated.

The cap of this design does include an expansive cover, being beveled at its edges to assure that proper drainage of rain or other elements therefrom. Located a sufficient distance downwardly from the cover is a band means, being spaced therefrom by means of the aforesaid foraminous member, and which foraminous member is of sufficient structrual strength so as to provide for the permanent retention of the cover heightwise with respect to the upper end of the flue. There is sufficient heighth between the chimney connecting band and the cap cover so that significant draft will develop to the leeward or laterally of the chimney top, which actually enhances the development of draft for attaining smoke discharge from the chimney, whereas, where such a cap is not employed, there is always the likelihood that wind can attain entrance substantially downwardly into the chimney and prevent development of sufficient draft for attaining its desired results. This latter detriment is particulary prevalent in those homes where the chimney is in close proximity or relationship with a sloping roof for the immediate or adjacent building with which the chimney is associated.

The band means of this invention includes various types of retentioners that may secure the cap snuggly in place upon the upper end of the chimney flue. The preferred retention means includes a series of appendages that extend downardly from the sides of the band means, more preferably at its corners, and since the appendages are formed as legs, constructed of resilient material, they have a tendency to bind tightly against the interior surface of the contiguous flue, and assure a snug fitting of the chimney cap in place. In addition, these appendages may be removable from their connection with the band means, so as to facilitate and lessen the space requirements for the cap during its storage, during transit, or while it is being displayed for marketing, but which appendages can be easily and quickly fastened into place, into a usable configuration, for snuggly retaining the chimney cap upon its associated flue. An advantage of utilizing this type of an appendage for retention purposes is that, in this particular embodiment, each leg is formed having at its upper end an inwardly extending portion, which functions also as a shoulder to retard any further movement of the chimney flue there past as when the cap is being installed in place upon the same, so as to provide for a reasonbly precise application of the cap onto the chimney flue, to assure its proper retention, but to also prevent the cap from sliding to far downwardly at which point the flue may become evident upon viewing it through the foraminous member, and which would otherwise have a tendency to prevent the development of that proper draft necessary for proper chimney functioning.

In addition to the foregoing, the band means incorporates appertures through which screws may be located for tightening against the chimney flue, and which means for tightenting may be applied individually for securing and holding the band, and its integral chimney cap, against the associated flue, or which screw fasteners may be used in conjunction with the aforesaid appendages for assuring a very firm mounting of the chimney cap upon the chimney flue.

DESCRIPTION OF THE PREFERRED EMBODIMENT

Figure 1:
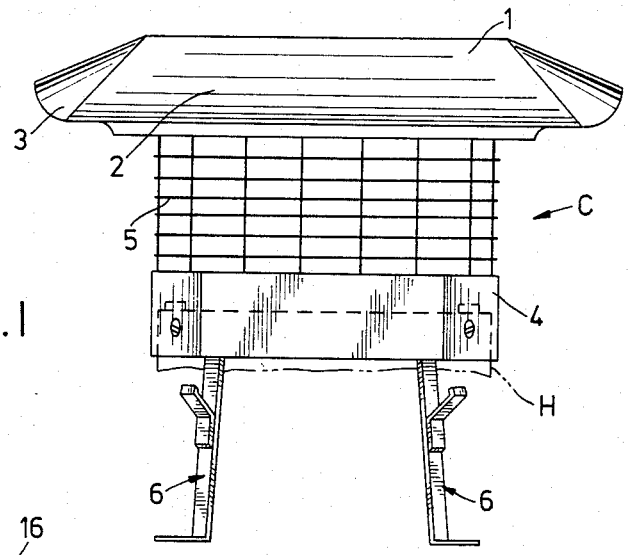
FIG. 1 provides a side view of the chimney cap of this invention, as mounted upon the upper end of a chimney flue, which is shown in phantom line.

In referring to the drawings, and in particular FIG. 1, there is disclosed the chimney cap C of this invention, shown in its mounting disposition upon the chimney head H of the chimney flue, the upper end of which flue is normally concealed within the interior of the chimney cap when mounted in place.

The chimney cap includes a cover means 1 which is of sufficient expanse both lengthwise and widthwise, so as to prevent the elements such as rain, snow, or the like, from attaining access directly downwardly into the chimney flue. At its outer edges the cover means is beveled, as at 2, being slightly crimped as at its ends, as at 3, which is done so simply to accommodate the pressing operation that attains beveling at this location for the formed cover or hood. Spaced downwardly, heightwise, from the cover 1 is a band means 4 which is substantially continuous in design, being welded or otherwise secured together at its ends, and possesses interior dimensions only slightly greater than the exterior of the flue tile upon which the cap is to mount. It might be commented at this juncture that the flue tiles normally associated within a designed chimney are of fairly standardized dimensions.

Arrange intermediate the cover 1 and the band means 4 is a reasonably stiff foraminous member, in this particular instance containing large gauge screen or wire, as at 5, and which is designed for securing with the band means, along its interior, and also attaching onto the inner surface of the cover means, and thereby providing for this fixed spacing intermediate the said cover and band means, as previously mentioned.

As can also be seen from this figure, there are a series of retention means structures, as at 6, provided approximately at each corner for the formed bands means 4, and which furnishes that structural means for rigidly securing the cap to the chimney head during its installation, and in an expeditous manner as previously explained. There are a series of appendages, namely the retention members 6, that extend downwardly from approximate each corner of the band means 4, and each appendage, there being four in number associated with the cap, is formed as a multibent leg 7, bent in a manner as to be hereinafter described. Each leg has an upper extending portion 8 that is disposed for attachment to the interior of the band means 4, and more specifically at its associated corner, as can be more accurately seen in FIG. 2. The legs of each retention mean is then bent approximately perpendicularly therewith, as at 9, extending inwardly of the band means, and therein forms a shoulder against which the top of the chimney flue comes to rest after the cap has been fully inserted and installed. Each leg then extends further downwardly, as at 10, and is angulated slightly outwardly, in the manner as shown, until at its bottom ends, each leg is bent once again, as at 11, as can be seen. The disposition of the lower outwardly bent ends 11 of each leg is at a location that is arranged approximately in alignment with the band means 4, so that after the cap has been installed upon the chimney flue, the legs will be forced slightly inwardly to compensate for the thickness of the flue tile upon which it mounts, and to present sufficient bias against the inner surface of the said flue so as to more permanently secure the chimney cap in place.

Most of these flue tiles, as previously explained, are of standardized dimensions, being either of square or rectangular design that is predetermined to provide that capacity needed for removal of smoke and fumes from the size of fireplace or furnace to be serviced, and in addition, the thickness of each flue tile is also of a highly standard dimension. Thus, the design of these legs, and their arrangement with respect to the band means, can be fairly reasonably determined and manufactured into the finished product in order to assure that sufficient pressure will be exerted upon these resilient appendages against the interior of the chimney flue, to assure retention of the cap thereon.

To provide for a double point pressure of each appendage 6 against the interior of the flue tile, it can be seen from these figures that a tab means 12 is also secured or otherwise welded to each leg 7, and has an outwardly extending portion that is sufficiently resilient so as to likewise bind against the interior of the flue tile, during application and installation of the chimney cap thereon.

Figure 2:
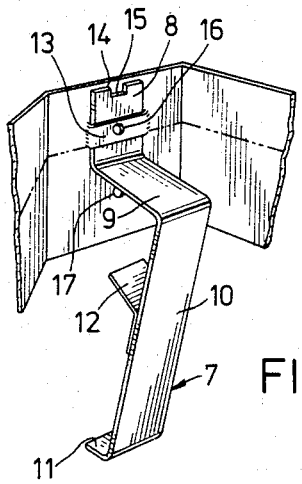
FIG. 2 discloses an inside corner of the band means for the chimney cap of this invention, showing one of the appendages being mounted thereto.
Figure 3:
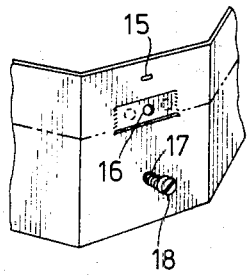
FIG. 3 provides an outside view of the same corner as shown in FIG. 2.

It can be readily determined that the appendages 6, and which are formed as the multibent legs 7, are removable in their mounting with the band means, and to its interior surface. For example, at each corner, the band means 4 has a formed support means, in the structure of a strap, as at 13, which may be either welded to the interior surface of each corner of the band means, or which can be press punched from the metal forming the band means itself, in the manner as shown in FIGS. 2 and 3. Each strap is of sufficient width to accommodate the insertion of the upper end 8 of the appendage leg 7, in a reasonably snug fitting, and both the upper end 8 of the leg 7, and the support strap 13, have aligned appertures therein, being threaded, or otherwise accommodating of a fastener for securement of the appendage leg 7 firmly to the interior surface of the band means corner. Thus, the attributes for this invention, as previously summarized, for providing an appendage or leg that is removably connectable with the chimney cap, and more specifically as band means, can be readily observed and determined upon reviewing the structure as explained herein. This facilitates not only the storage, packaging, and shipment of the product, but it also can be merchandized for sale taking up much lesser space than had heretofore been required for an invention of this type.

It is also to be noted that the upper end of the leg portion 8 is notched, as at 14, and into this notch may insert an integral stop that is pressed from the corner of the band means, with the stop being more clearly seen at 15, that is punched inwardly from the corner of the band means 4, as can also be seen from FIG. 3. This particular stop is useful for providing a locating of appendage leg 7, after it has been inserted through its strap support 13, and readied for fastening by means of a screw, or the like, that threads through the appertures 16, as previously described.

It can also be seen from FIG. 3 that another threaded apperture 17 is provided through each corner of the band means 4, slightly downwardly from where the strap support is formed therein, and within this apperture a retention means, such as the screw 18, as shown, may locate. Once the chimney cap has been located in place upon the chimney flue, with its appendage legs 7 inserted downwardly therein, and biasing with some force against the interior of the chimney cap, while this may be sufficient to hold the cap in place, sometimes it is desirable to add further structural means for assuring the retention of the cap in place. Hence, once the chimney cap is located upon the flue, the threaded screws 18 may be tightened for threading inwardly of the band means 4, with the inner edges of the screws snugly tightening against the flue tile that is now arranged contiguously within the interior of the band means 4 of the chimney cap. One of these retention means 18 may be provided at each corner of the band means 4, of the chimney cap, to assure a snug retention of the same in place.

Figure 4:
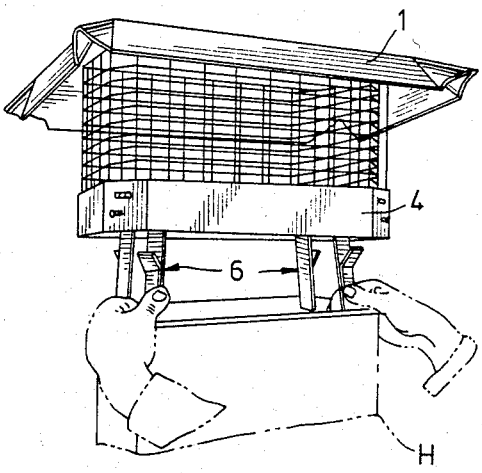
FIG. 4 discloses an isometric view of the chimney cap of this invention being installed upon a chimney flue.
Figure 5:
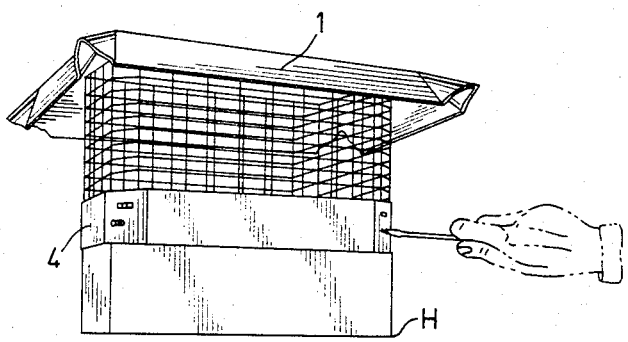
FIG. 5 provides a view of the chimney cap of FIG. 4 fully mounted in place, with the final fastening screws being tightened in place so as to assure a snug fixing of the cap upon the said chimney flue.

The installation of this particular design for the chimney cap of this invention is likewise reasonably simple, and as can be seen in FIGS. 4 and 5, two of the four appendages, along one side of the cap, are intially inserted into the flue tile, along its upper edge, and then the other two appendages receive an inwardly exerting pressure on their lower portions until such time as they also become inserted and located upon the interior surface of the same tile. Then, a pushing force directed straight downwardly upon the cap gradually forces the further insertion of the four appendages within the chimney flue or lining, until such time as the upper edge of the flue comes into contact with the formed leg shoulders, as depicted by the leg portion 9, at which time the cap will now be fully inserted and installed and ready for useful service. And, as previously explained, to assure the complete and snug retention of the cap in place, the screw means 18 may be tightened until they bind against the exterior of the chimney cap flue tile.

Variations or modifications to the structure of this invention may occur to those skilled in the art upon reviewing the subject matter of this invention. Such variations, if within the spirit of this invention, are intended to be encompassed within the scope of any claims to patent protection issuing hereon. The description of the preferred embodiment set forth herein is done so primarily for illustrative purposes only.

Having thus described the invention what is claimed and desired to be secured by Letters Patent is:

1. In a chimney cap for use in providing coverage for the upper end of the formed chimney flue and thereby preventing the entrance of any extraneous elements therein, comprising, a cover means provided upwardly of the flue and preventing the entrance of rain or other elements downwardly into the chimney flue, a band means arranged downwardly of the said cover means and designed for proximity fitting upon the said chimney flue, said cover means and band means being spaced apart a distance heightwise to allow sufficient draft to develop and remove smoke and fumes from the chimney flue, a foraminous means arranged connecting with both the said cover means and band means and disposed for spanning the space in between the said means and arranged substantially in alignment with the said band means, retention means operatively associated with the said band means for assuring its securement with the chimney flue upon which it seats, said retention means including a series of appendages connecting with the band means and projecting downwardly therefrom for extending into and biasing against the interior of the chimney flue for securement of the cap therewith, said appendages being removable from the band means, said band means being formed having a series of sides, adjacent sides of the band means being intervened by a substantially flattened corner, there being an appendage securing with each said band means corner to assure snug securement of the chimney cap with its flue, each appendage being formed of resilient material, each appendage including a leg that removably connects with the band means, extends inwardly and then downwardly to its lowest end, said appendage being arranged for biasing against the interior of the chimney flue for securing said cap firmly in place, a support means provided with the band means at each said corner, each support means being a strap provided interiorly of the band means corner, there being a space provided between the strap and band means with the associated appendage inserting therein and being substantially aligned and contiguous with its associated band means thereat, and fastening means securing through said support means for fixing the appendate in place.

2. The invention of claim 1 and wherein said fastening means being removable, and said appendage being removable from its band means.

3. The invention of claim 1 and wherein said inwardly extending portion of the leg of the appendage functions as a shoulder means to limit the extent of insertion of the chimney flue within the band means during installation of the said chimney cap.

4. The invention of claim 1 and including another fastening means securing through each corner of the band means and upon tightening fixing the said band means and the chimney cap with its disposed chimney flue.

5. The invention of claim 1 and including a stop means associated with the band means and functioning to limit the extent of insertion of the appendage through its associated support means.

6. The invention of claim 1 and including a tab means securing upon the downwardly extending portion of each leg means, said tab means designed for also biasing against the interior of the chimney flue for holding the said cap firmly in place, the combination of the downwardly disposed leg and the said tab means providing a double point contact of the appendage with the interior of the chimney flue to assure its securement in place.

* * * * *